US005235667A

United States Patent [19]

Canfield et al.

[11] Patent Number: 5,235,667

[45] Date of Patent: Aug. 10, 1993

[54] HEATING METHOD AND ASSEMBLY UTILIZING ELECTRIC HEATING ELEMENTS IN CONJUNCTION WITH COMBUSTION

[75] Inventors: Douglas Canfield, Suffern; David Jacobson, Pomona, both of N.Y.

[73] Assignee: Casso-Solar Corp., Pomona, N.Y.

[21] Appl. No.: 707,150

[22] Filed: May 24, 1991

[51] Int. Cl.[5] ..... F24C 1/00; F24C 11/00

[52] U.S. Cl. ..... 392/307; 432/175; 432/31; 392/432; 431/328

[58] Field of Search ..... 392/307, 432–440; 431/328, 329; 126/92 AC-92 C; 432/12, 94, 175, 31

[56] References Cited

U.S. PATENT DOCUMENTS

| | | | |
|---|---|---|---|
| 2,921,176 | 1/1960 | Scofield | 392/307 |
| 2,999,534 | 9/1961 | Wagner | 431/328 |
| 3,024,836 | 3/1962 | Bello | 431/328 |
| 3,057,400 | 10/1962 | Wagner | 431/329 |
| 3,073,379 | 1/1963 | Martin | 431/328 |
| 3,784,353 | 1/1974 | Chapurin | 431/329 |
| 4,634,373 | 1/1987 | Rattner | 431/328 |

FOREIGN PATENT DOCUMENTS

| | | | |
|---|---|---|---|
| 1352946 | 1/1964 | France | 431/328 |
| 63-87514 | 4/1988 | Japan | 431/329 |
| 2086565 | 5/1982 | United Kingdom | 392/307 |

*Primary Examiner*—Bruce A. Reynolds
*Assistant Examiner*—John A. Jeffery
*Attorney, Agent, or Firm*—Stanley J. Yavner

[57] ABSTRACT

A heater for radiant heating of an object in a heating tunnel, furnace or the like has a layer of ceramic fibers through which a fuel/air mixture is fed for combustion at the surface and use of the heater as a gas burner. Partly embedded in the surface is an electrical-resistance heater which is heated up by the burner action and then can be energized to provide controlled heating of the object when the gas is shut off. A flow of cooling air through the heater can terminate the heating operation and rapidly quench the heater.

20 Claims, 2 Drawing Sheets

HEATING METHOD AND ASSEMBLY UTILIZING ELECTRIC HEATING ELEMENTS IN CONJUNCTION WITH COMBUSTION

FIELD OF THE INVENTION

Our present invention relates to a heating method and assembly and, more particularly, to a method of controlledly heating an object and to an assembly which includes a radiant heater for such heating.

BACKGROUND OF THE INVENTION

For the large-area heating of objects, it is common to pass the objects through a heating tunnel, furnace, kiln or lehr which can have heaters disposed along the path of the objects to be heated and spacedly juxtaposed with them for radiant heating of the objects. This technique has been used for a wide variety of purposes, including the annealing or tempering of glass, the heating of glass to impart curvature thereto, for the curing of surface coatings, for the drying of coatings, for the drying of objects and for a variety of thermal treatments of ceramic, glass, metal or composite articles.

Reference may be made, for example, to U.S. Pat. Nos. 4,531,047 and 4,601,743 by way of example of such heating paths.

In those systems, quartz heaters are used for careful control of the heating and the object utilizing electricity as the energy source. Electrically energized radiant heaters provide an opportunity for fine control of the heating operation.

It is also known to utilize other energy sources for heating in similar applications. For example, a combustible fuel may be supplied to a burner to generate a flame which is employed to heat the object.

Where radiant heating is desired, a burner of the type described in U.S. Pat. No. 4,547,148 may be used. That patent describes a radiant gas-fired burner having a back plate for connection for a supply of air and gas which, together with a combined refractory fiber pad and metal support structure, defines a plenum to which the combustible air/gas mixture is supplied. A perforated metal member is interlocked with the porous pad of refractory fibers as a support for it and through the perforations of this member, the fuel/air mixture is supplied to the porous layer so that combustion can be sustained at the surface thereof which can be spacedly juxtaposed with an object.

Both gas burners and electrically-energized radiant heaters have advantages and disadvantages for most of the applications described. For example, a gas burner can deliver radiant energy at two to three times the delivery rate of electrical heaters but has the drawback that the heating cannot be controlled or regulated with great precision. Electrical heaters have the advantage that they can be controlled with precision and both types of heaters frequently are characterized by a slow cool down rate.

Electrical heaters generally have start-up inertia, i.e. cannot be brought to the optimum temperature level rapidly. As a consequence, it has been necessary for the design of a heating tunnel or furnace to be a compromise based upon these different characteristics.

OBJECTS OF THE INVENTION

It is the principal object of the present invention to provide an improved heating method whereby drawbacks of earlier methods are avoided.

It is also an object of our invention to provide an improved heater assembly which has advantages of both gas burner heaters and electrically-energized radiant heaters and which, in addition, allows rapid cool-down.

Another object of the invention is to provide an easily-controlled heat without the start-up inertia of prior art electrical heaters and which also permits rapid cool-down.

SUMMARY OF THE INVENTION

These objects and others which will become apparent hereinafter are attained, in accordance with the method aspect of the invention in a method of controlledly heating a object which comprises the steps of:

(a) feeding a fuel gas through a porous layer spacedly juxtaposed with an object to be heated and combusting the fuel gas on a surface of the layer to generate radiant heat heating the object; and (b) thereafter terminating feed of the fuel gas through the layer while continuing to heat the object by electrically energizing at least one resistive heater element on the surface.

According to a feature of the invention, after the resistive heater element is de-energized, a flow of cooling gas, generally air, is passed through the layer to cool the surface of that layer and the resistive heating element. The heating of the object can be controlled by monitoring the temperature, e.g. the temperature at the surface of the layer and varying the electrical energization of the element in response to the monitored temperature.

By providing the surface of the panel with a plurality of resistive heating elements, according to another feature of the invention, we can differentially heat respective regions of the object with the heating elements.

One of the advantages of the invention is that the resistive heating element or elements can be heated by the gas-fired combustion and thus can be at an elevated temperature when resistive heating commences.

Because of the high rate of radiant heat delivery afforded by the combustion, objects can be heated up to a desired degree before the electrically-energized heating comes into play to provide precise control of the heating in terms of temperature or the locale at which the heating occurs. Furthermore, the electrical heating can be followed by the supply of cooling gas through the layer and the surface to rapidly cool the latter and the heating elements and thereby quickly terminate a heating operation for precise control of the heating duration without significant thermal inertia.

The thermal inertia can be especially low when the layer is an alumina-silica ceramic fiber layer as described in U.S. Pat. No. 4,547,148.

According to another feature of the invention, while the heating is carried out with the fuel gas, the resistive heater is energized, e.g. to modulate the overall heating effect.

According to the apparatus aspects of the invention, a heater assembly for heating an object spacedly juxtaposed therewith can comprise:

a porous layer of a refractory material having a surface;

means for distributing a fuel gas to the layer at a side thereof opposite the surface whereby the fuel gas penetrates through the layer and undergoes substantially uniform combustion at the surface to heat the object;

at least one electrically energizable resistance heating element on the surface; and means for electrically energizing the heating element for radiant heating of the object therewith.

The resistive heating element is partly embedded in the layer at the surface. The surface can be flat or curved and, according to a feature of the invention, can conform in contour to the contour of a surface of the object to be heated or to a temperature gradient to be provided in the object to be heated.

When the layer is provided with a recess at its back constituting the aforementioned plenum and closed by a back plate, the back plate can be formed with a fitting for connecting the piping supplying the fuel/air mixture to the layer. With termination of the gas heating, the supply of this mixture can be cut off and electrical energization of the preheated resistance heating element can be effected. Following resistance heating, the air supply can be turned on to rapidly quench the temperature of the heater, as may be desired.

The back plate may be provided with the electric terminals for connection to the resistive heater element, and, if desired, with a pressure gauge to indicate the pressure of the gas in the recess or plenum.

The system of the invention thus provides the rapid heat-up associated with a gas burner and quick cool-down when a cooling gas is fed through the heater. It allows precise control of the heating operation with instant "on" of the electric heater because the latter is preheated by the combustion. Precise control is effected by the thermocouple.

The heater panel can have a modular dimension enabling it to be assembled with other similar heaters for large-area heating and the panels can provide differential resistive heating if differentially energized and can include a plurality of resistive heating elements for differential heating using a single panel. The panels need not be of rectangular configuration and can have other advantageous shapes, such as trapezoidal or triangular shapes.

While the resistive heating element will usually be a coil, other heating elements such as wire, ribbon or bars may be used.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
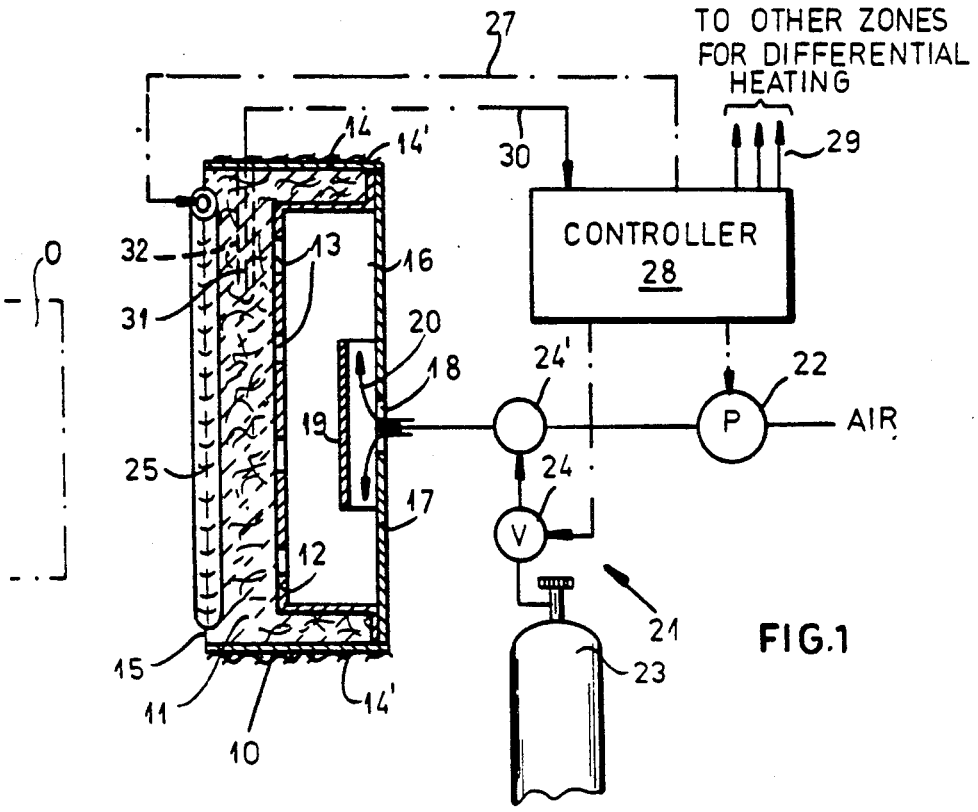
FIG. 1 is a diagram illustrating principles of the invention.

In FIG. 1 I have shown a heater assembly illustrating the principles of the invention.

In this Figure, the heater 10 is shown to comprise a layer 11 of alumina-silica ceramic fibers which has been vacuum formed or otherwise applied to a perforated support plate 12 whose perforations are shown at 13. Around the edge of this layer, a flange 14 of a back plate 17 extends to prevent the escape of the fuel/air mixture or ineffective combustion thereof along the edges. This flange 14 can be surrounded by a tape 14' of a woven ceramic fiber or some other refractory web.

To ensure effective distribution of the mixture through all of the perforations 13 of the plate 12, a diffuser 19 is provided and ahead of the port 18 to deflect the flow outwardly as represented by the arrows 20. The means for supplying the fuel/air mixture has been represented at 21 and can include an air blower 22 and a source 23 of a fuel gas, here shown as a tank or bottle. The fuel may be any conventional combustible gaseous fuel, such as methane, propane or butane or mixtures thereof. A valve 24 controls the feed of the gas to the mixer 24'.

While no special means for igniting the fuel/air mixture at the surface 15 has been illustrated, it will be understood that any conventional igniter, for example, a piezoelectric or glow-wire igniter can be provided as required.

Figure 2:
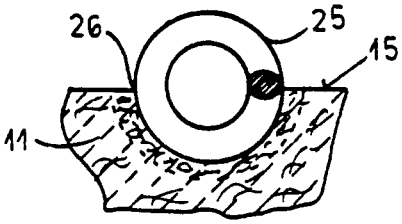
FIG. 2 is a detail section showing a resistance heating coil partly embedded in the ceramic fiber layer forming the burner surface.
Figure 9:
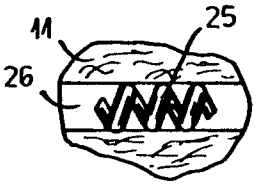
FIG. 9 is a detail front view showing a portion of a face of the panel according to the invention.

Partly embedded in the surface 15 is a resistive heating coil 25 as can be better seen from FIGS. 2 and 9. The coil 25 is shown to be embedded up to half of its circumference in the layer 11 and thus is bedded in a groove 26 therein. Of course the coil can be fully embedded or even merely held in contact with the layer as desired. Any conventional bonding between the heating element 25 and the ceramic fibers of the layer can be used. For example, the coil can be cemented in place and/or pressed into the fiber layer with sufficient force to enable its retention, or the fiber layer can be pressed into and around the coil. The resistive heating element need not be a coil, but can be a tape, ribbon, wire (corrugated or uncorrugated), rod or the like.

The electrical energization of the coil 25 is represented by the line 27 from a controller 28 which can also control other resistance heaters as represented at 29 for differential heating of the object. The controller also operates the valve 24 and the blower 22.

Thus in operation, rapid heat-up is initially effected by opening the valve 24 and energizing the blower 22 to force the fuel gas/air mixture through the layer 11 so that combustion is sustained along the surface 25 and the object represented only at O in FIG. 1 is heated with the radiant heat thus produced. When the object is brought up to a desired temperature and thereafter careful control of the heating is desired, the controller 28 shuts down the valve 24 and the blower 22 and electrically energizes the resistance heating zones. Resistance heating at the desired temperature commences immediately because the resistance heaters have been preheated by the burner operation. Alternatively, the gas heating can be maintained while the resistance heaters are operated to allow the resistance-heat contribution to modulate a primarily gas heating.

The heating can be controlled by an input 30 from a thermocouple 31 in a well 32 in the layer 11. Following the controlled radiant heating from the electrically-energized heaters, the heaters can be de-energized and the blower 22 turned on by the controller 28 so that cool air is blown through the layer to rapidly cool the latter and the heating elements 25 and thereby terminate the heating operation.

Figure 3:
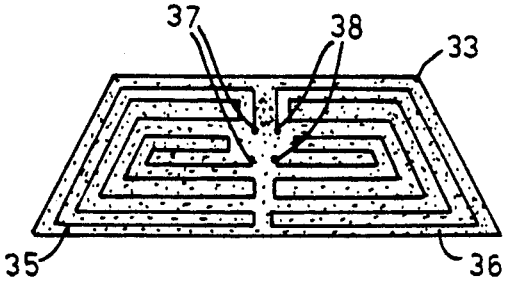
FIGS. 3 and 4 are elevational views diagrammatically illustrating other configurations of the heater according to the invention.
Figure 4:
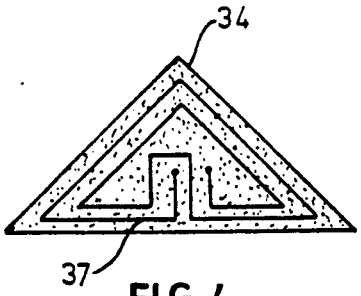
Figure 8:
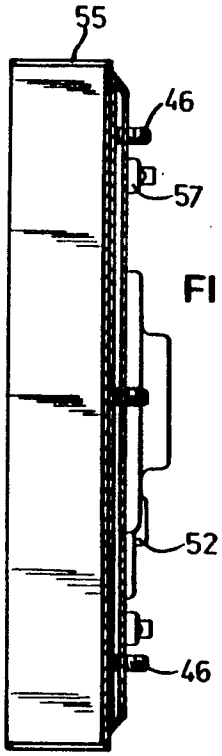
FIG. 8 is a side elevational view of the panel.
Figure 6:
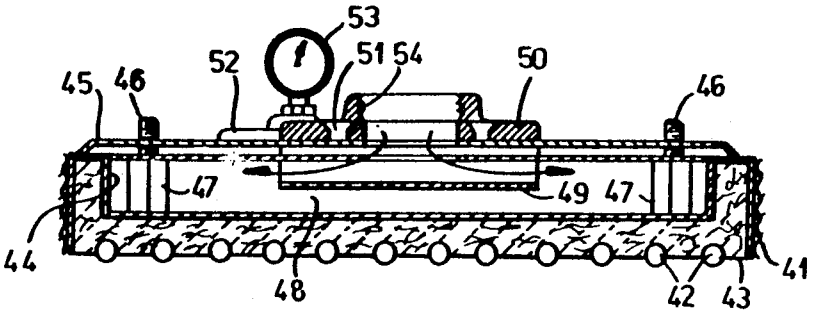
FIG. 6 is a cross section through a rectangular heating panel according to the invention.
Figure 7:
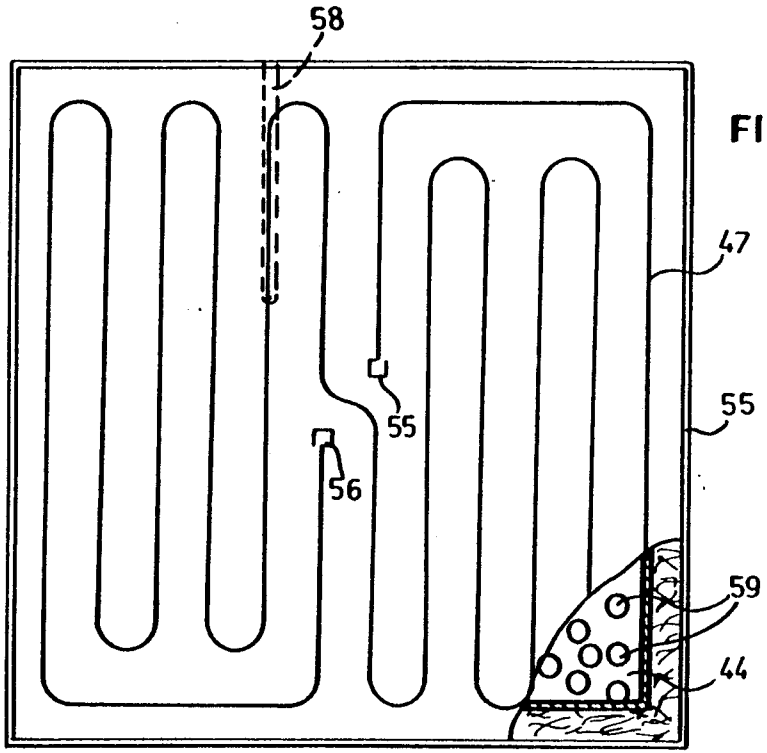
FIG. 7 is a front view thereof partly broken away.

As can be seen from FIGS. 3 and 4, the heating panels need not have rectangular shapes as is the case with the embodiment of FIG. 1 and the embodiment of FIGS. 6–8, but can be trapezoidal as shown at 33 or triangular as shown at 34.

In FIG. 3 we have also indicated that the number of heating zones provided by the resistance heaters can be greater than one. Here for example two heating zones 35 and 36 are provided by respective resistance heaters having respective terminals 37 and 38. Generally the terminals will extend through the back plate of the heater as will be described in connection with FIG. 8. It should also be noted that the distribution of the resistive heating elements on the surface will also determine the radiant heating from each surface segment and thus can determine a differential heating of the object. Only a single heater 37 is provided in the embodiment of FIG. 4.

Figure 5:
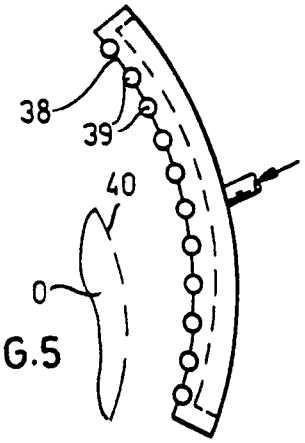
FIG. 5 is a diagrammatic side elevational view showing a curved heater according to the invention.

In the embodiment of FIG. 5, the heating surface 38 in which the electric heating element 39 is partly embedded is shown to be curved to effect a differential heating operation or to conform to a curved surface 40 of the object to be heated.

FIGS. 6–8 show a construction of the heater in greater detail.

In this construction it can be seen that the porous fiber layer 41 in which the heater coil 42 is partly embedded at the surface 43, is formed on the perforated plate 44 which is secured to the back plate 45 by screws 46 and stand-offs 47 maintaining the plenum or recess 48. The diffuser 49 is connected to the back plate to which a fitting 50 is also connected by screws through holes 51. The fitting 52 for a pressure gauge 53 indicating the pressure in the plenum 48 has also been shown.

The fitting 50 has a threaded bore 54 into which a pipe blowing the fuel/air mixture or the cooling air can be threaded.

In FIG. 7, the pattern of the coil 42 has been shown together with its terminuses 55 and 56 which ar connected to electrical terminals passing through the back plate and one of which has been illustrated at 57 in FIG. 8. The thermowell in which the thermocouple can be received has been shown at 58 in FIG. 7 and the perforations 59 in plate 44 are also visible therein.

We claim:

1. A method of controlledly heating an object, comprising the steps of:

(a) feeding a fuel gas through a porous layer spacedly juxtaposed with an object to be heated and combusting said fuel gas on a surface of said layer to generate radiant heat heating said object only by said fuel gas; and (b) thereafter terminating feed of said fuel gas through said layer while simultaneously electrically energizing at least one resistive heating element, thereby continuing to heat said object with at least the same level of heating temperature as is achieved by fuel gas combustion alone.

2. The method defined in claim 1, further comprising the step of de-energizing said heater element and passing a cooling gas through said layer to cool said element and said surface rapidly.

3. The method defined in claim 1, further comprising the step of controlling the heating of said object by monitoring a temperature and varying electrical energization of said element in response to the monitored temperature.

4. The method defined in claim 3 wherein said temperature is monitored at said surface.

5. The method defined in claim 1, wherein said surface is formed with a plurality of resistive heating elements, said method further comprising differentially heating respective regions of said object with said elements.

6. A method of controlledly heating an object, comprising the steps of:

(a) feeding a fuel gas through a porous layer spacedly juxtaposed with an object to be heated and combusting said fuel gas on a surface of said layer to generate radiant heat heating said object;

(b) thereafter terminating feed of said fuel gas through said layer while continuing to heat said object by electrically energizing at least one resistive heater element on said surface; and (c) heating said element by combustion of said gas before electrically energizing said element.

7. The method defined in claim 1, further comprising the step of conforming a contour of said surface at least generally to a contour of said object juxtaposed with said surface.

8. A method of controlledly heating an object, comprising the steps of:

(a) feeding a fuel gas through a porous layer spacedly juxtaposed with an object to be heated and combusting said fuel gas on a surface of said layer to generate radiant heat heating said object; and (b) electrically energizing at least one resistive heater element on said surface for heating of the object by a combined heat of combustion of said fuel gas and heat from said element in order to maintain at least the same level of heating temperature as is achieved by fuel gas combustion.

9. A heater assembly for heating an object spacedly juxtaposed with the heater, said heater assembly comprising:

a porous layer of a refractory material having a surface;

means for distributing a fuel gas to said layer at a side thereof opposite said surface whereby said fuel gas penetrates through said layer and undergoes substantially uniform combustion at said surface to heat said object with a predetermined heating temperature level;

at least one electrically energizable resistance heating element on said surface; and means for electrically energizing said heating element for radiant heating of aid object therewith, said means for energizing further including control means responsive to a predetermined temperature condition, whereby said heating element maintains said level.

10. The heater assembly defined in claim 9 wherein said element is partly embedded in said layer at said surface.

11. The heater assembly defined in claim 9 wherein said surface is flat.

12. The heater assembly defined in claim 9 wherein said surface is curved.

13. The heater assembly defined in claim 9 wherein said layer is composed of alumina-silica ceramic fibers.

14. The heater assembly defined in claim 9 wherein a plurality of resistive heating elements are provided at said surface and are separately energizable for differential heating of respective portions of said object.

15. The heater assembly defined in claim 9 wherein said layer defines a recess at said side and said assembly comprises a back plate closing said recess and formed with a fitting communicating between said recess and a source of said fuel gas.

16. The heater assembly defined in claim 15, further comprising terminals connected to said back plate for energizing said element.

17. The heater assembly defined in claim 15, further comprising means for connecting a pressure gauge to said recess.

18. The heater assembly defined in claim 15, further comprising means for connecting a source of cooling gas to said recess for feeding said cooling gas through said layer to cool said surface and said element.

19. The heater assembly defined in claim 14, further comprising a thermocouple at said surface for controlling energization of said element.

20. The heater assembly defined in claim 9 wherein said element is a coil.

* * * * *